US005333458A

United States Patent [19]

Loving

[11] Patent Number: 5,333,458

[45] Date of Patent: Aug. 2, 1994

[54] LIQUID FUEL POWER PLANT

[75] Inventor: Ronald E. Loving, Simi Valley, Calif.

[73] Assignee: Hughes Aircraft Company, Los Angeles, Calif.

[21] Appl. No.: 4,375

[22] Filed: Jan. 14, 1993

[51] Int. Cl.[5] ..... F02C 1/00

[52] U.S. Cl. ..... 60/722; 60/752; 431/353

[58] Field of Search ..... 60/39.827, 39.828, 722, 60/737, 738, 752, 753; 431/11, 245, 246, 350, 353

[56] References Cited

U.S. PATENT DOCUMENTS

| | | | |
|---|---|---|---|
| 2,626,655 | 1/1953 | Trautman et al. | 60/39.141 |
| 2,641,904 | 6/1953 | Bouffart | 60/722 |
| 2,698,050 | 12/1954 | Bloomer et al. | 60/753 |
| 3,012,402 | 12/1961 | Probert et al. | 60/722 |
| 3,434,012 | 3/1969 | Rademacher | 60/39.828 |
| 4,047,881 | 9/1977 | Eschenauer et al. | 431/353 |
| 4,077,761 | 3/1978 | Dollinger et al. | 431/353 |
| 4,878,480 | 11/1989 | Watson et al. | 431/353 |

*Primary Examiner*—Richard A. Bertsch
*Assistant Examiner*—Michael I. Kocharov
*Attorney, Agent, or Firm*—W. K. Denson-Low

[57] ABSTRACT

A liquid fuel power plant (100) including an open-ended combustion chamber (102) and a first mechanism (110) for delivering a combustible fuel to the open-ended combustion chamber (102). A second mechanism (136) is included for igniting the fuel in the open-ended combustion chamber (102). A folded tubular mechanism (140) is provided for extending the length of the combustion chamber (102) to decompose the ignited fuel and to provide an exhaust gas comprised of fundamental elements. Finally, a third mechanism (160) is provided for using the exhaust gas to perform useful work. In a preferred embodiment the liquid fuel power plant (100) includes separate fuel and air inlet lines (110, 120). The air inlet line (120) delivers compressed air, which can be preheated, in an air passageway (130) and thereafter is mixed with the combustible fuel in the open-ended combustion chamber (102). An igniter (136) causes combustion of a compressed air-fuel mixture in an ignition region (118) of the combustion chamber (102). The residue of the combusted air-fuel mixture is thereafter forced by the compressed air into a folded tubular extension (140) which forms a reaction region (152) of the combustion chamber (102). The reaction region (152) becomes sufficiently hot to ensure complete decomposition of the combustible fuel. The hot pressurized exhaust gas, which is very low polluting, is directed by an exhaust tube (150) to a load such as a turbine (160).

9 Claims, 4 Drawing Sheets

100
TURBINE
160
150
140
142
133
148
133
144
131
130
141
2
2
152
104
128
129
102
131
132
128
129
132
118
130
136
144
138
146
106
116
114
134
135
108
FROM FUEL SUPPLY
112
FUEL PUMP
124
110
120
126
AIR COMPRESSOR
122
FROM COMPRESSOR DRIVE

FIG. 2
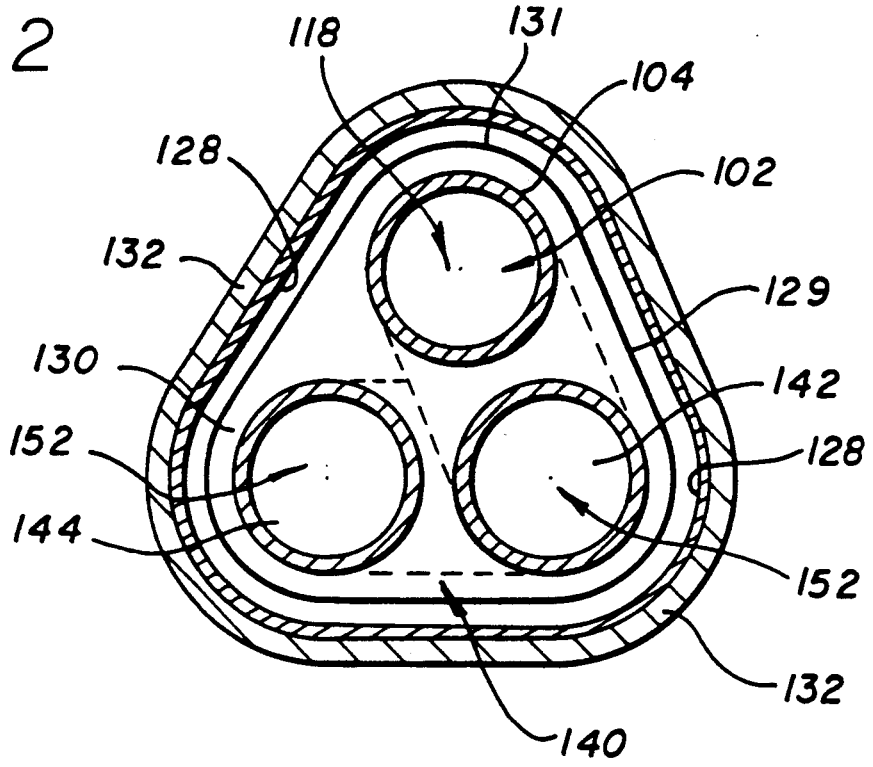
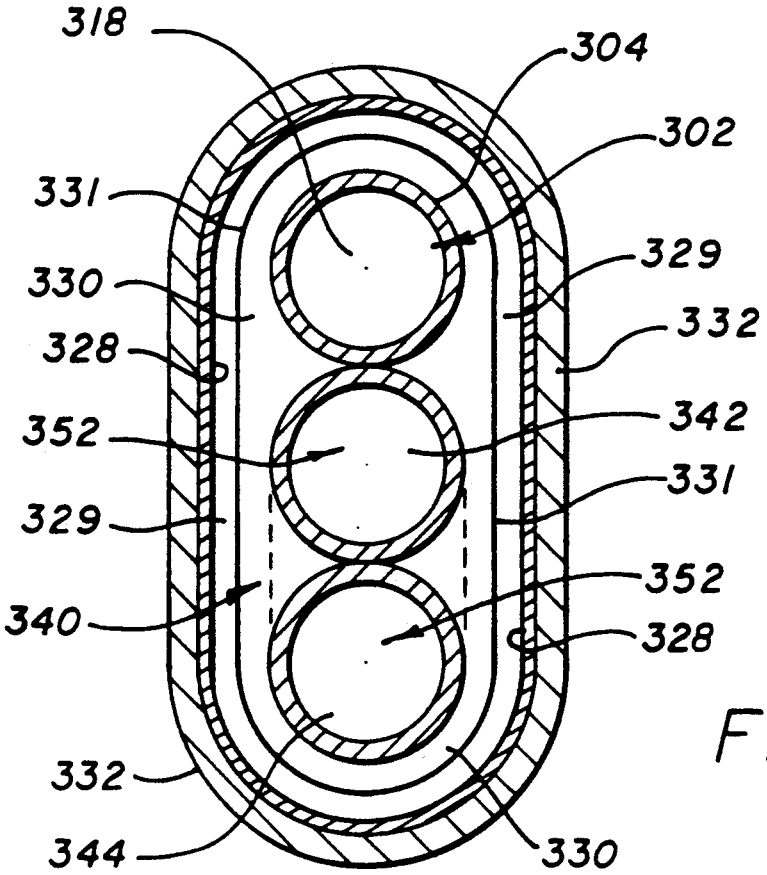
FIG. 5

300
FROM FUEL SUPPLY
FUEL PUMP
312
310
324
334
335
308
320
326
AIR COMPRESSOR
322
FROM COMPRESSOR DRIVE
TURBINE
360
350
340
333
348
331
330
341
329
304
328
302
318
336
338
306
316
314
332
342
352
344
346
5
5

LIQUID FUEL POWER PLANT

BACKGROUND OF THE INVENTION

1. Field of the Invention

The present invention relates to power plants. More specifically, the present invention relates to methods and apparatus for a very low polluting power plant having a liquid fuel combustion chamber for the burning of hydrocarbon based fuels.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

2. Description of the Related Art

Many different types of liquid fueled power plants are known in the art for providing thrust for propulsion, power generation and other applications . Examples include liquid fueled jet engines , piston engines and rocket motors of various designs. Conventional liquid fueled power plant designs tend to suffer from a number of problems not the least of which is the generation of excessive heat and noise. Also, in the case of a conventional liquid fueled rocket motor, a considerable amount of smoke can be generated which results in increased levels of atmospheric pollution.

In any event, the generation of excessive heat, noise and smoke during the launch and flight stages increases the probability that the projectile will be detected on approach. As the projectile becomes detectable, the launch point becomes detectable as well. Likewise, when driving a generator with, for example, a liquid fueled piston engine, the smoke exhaust from the engine increases the atmospheric pollution level.

Specific examples of liquid fueled power plant designs capable of providing thrust to propel a projectile include a liquid fueled turbine jet engine and a liquid fueled ramrocket motor. Turbine jet engines employing liquid fuel are known and are capable of providing thrust to propel a projectile and to provide rotational power to ground based power generator plants. In general, a turbine jet engine has a long cylindrical body and includes one or more liquid fuel burning chambers. The burning chamber is located at the center of the long cylindrical body and normally burns at temperatures in excess of three-thousand degrees Fahrenheit. The turbine jet engine includes multiple compression stages which produces a very high pressure in the burning chamber. When the liquid fuel is injected into the burning chamber, the fuel is combusted to provide hot, high pressure gases and enormous output horsepower.

The outer walls of the burning chamber are at a lower temperature than that of the flame at the center of the burning chamber. Because of the temperature differential between the flame and the outer wall and the operating temperature of the burning chamber, the liquid fuel is not totally combusted. The liquid fuel is generally a hydrocarbon based fuel. When particles of a hydrocarbon based fuel are not totally burned, hydrocarbon based pollutants are produced. Further, since all of the liquid fuel is not totally combusted, the turbine jet engine is not fuel efficient. Additionally, the turbine jet engine is very noisy and produces excessive heat. Each of these characteristics of turbine jet engines increases the detectability of a projectile and the pollution level of the atmosphere.

The second example of a known liquid fueled power plant design capable of providing thrust to propel a projectile is a ramrocket motor. The ramrocket motor is a hybrid rocket motor generally having a short motor casing. The length of the motor casing is approximately three times the diameter of the rocket motor combustion chamber. The ramrocket motor burns liquid fuel which is injected into the combustion chamber along with compressed ambient air. The output of the combustion chamber is a hot pressurized gas which is directed to an impulse turbine blade that rotates a propeller or ducted fan. Ramrocket motors are normally utilized with air breathing missiles or any application that utilizes hot pressurized gas.

The combustion chamber of the ramrocket motor includes a device that provides a flame at the center of the rocket motor. Thus, the center of a ramrocket motor also operates at a temperature in excess of three-thousand degrees Fahrenheit. A high volume of air is forced through the rocket motor causing the temperature of the outer wall of the combustion chamber to be lower than the temperature at the center of the combustion chamber. The temperature differential between the center and the outer wall of the rocket motor results in incomplete combustion of some liquid fuel drops. This condition produces hydrocarbon and carbon pollution which is exhausted to the atmosphere. Therefore, liquid fueled rocket motors must be preheated to a specific temperature range to ensure total combustion of the fuel. Otherwise, a fuel efficiency problem results.

Further, the desired combustion temperature range of operation within the ramrocket motor is difficult to control. If the desired combustion temperature range is not maintained, the flame at the center of the combustion chamber is extinguished because of the length-to-diameter ratio of the motor casing. Further, ramrocket motors must be operated very hot and fuel rich to avoid extinguishing of the combustion chamber flame. This situation results in fuel waste. Additionally, if the liquid fuel and compressed air are not properly mixed, residue smoke in the form of carbon particles appears in the exhaust gases. The smoke residue permits the projectile to be optically tracked. Finally, the ramrocket motor is very noisy which permits the projectile to be tracked by an audible sensor. Each of these characteristics of ramrocket motors increases the detectability of the projectile and the pollution level of the atmosphere.

A final example of a liquid fuel power plant design of the prior art is an incinerator employed for destroying hazardous waste. The incinerator includes a cylindrical combustion chamber joined by a flat circular plate to a smaller inlet pipe. Fuel nozzles protrude through the flat plate into the combustion chamber. The air and fuel are not premixed but rather are injected into the combustion chamber at the point of flame stabilization. Total combustion of the fuel occurs and low nitrous oxide ($NO_x$) levels are produced. Recirculation of the gas and air mixture is employed to ensure total combustion. The heat generated by the combustion is released to the atmosphere through a long hot exhaust tube that completes the decomposition of the hydrocarbon and carbon molecules.

Thus, there is a need in the art for improvements in the design of liquid fueled power plants to reduce the detectability of and the exhausted pollutants from the power plants.

SUMMARY OF THE INVENTION

The need in the art is addressed by the liquid fuel power plant and method of the present invention. The invention includes an open-ended combustion chamber and a first mechanism for delivering a combustible fuel to the open-ended combustion chamber. A second mechanism is included for igniting the fuel in the open-ended combustion chamber. A folded tubular mechanism is provided for extending the length of the combustion chamber to decompose the ignited fuel and to provide an exhaust gas comprised of fundamental elements. Finally, a third mechanism is provided for using the exhaust gas to perform useful work.

In a preferred embodiment, the liquid fuel power plant includes separate air and fuel inlet lines. The air inlet line delivers compressed air, which can be preheated, in an air passageway and thereafter is mixed with the combustible fuel in the open-ended combustion chamber. An igniter causes combustion of a compressed air-fuel mixture in an ignition region of the combustion chamber. The residue of the combusted air-fuel mixture is thereafter forced by the compressed air into a folded tubular extension which forms a reaction region of the combustion chamber. The reaction region becomes sufficiently hot to ensure complete decomposition of the combustible fuel. The hot pressurized exhaust gas, which is very low polluting, is directed by an exhaust tube to a load such as a turbine.

BRIEF DESCRIPTION OF THE DRAWINGS

FIG. 2 is a cross-sectional view taken along the line 2—2 of FIG. 1 showing the folded tubular construction of the combustion chamber extension and an outer cylindrical wall and a heat shield surrounding the combustion chamber and extension.

FIG. 5 is a cross-sectional view taken along the line 5—5 of FIG. 4 showing the folded tubular construction of the combustion chamber extension and an outer cylindrical wall and a heat shield surrounding the combustion chamber and extension.

DESCRIPTION OF THE INVENTION

Figure 1:
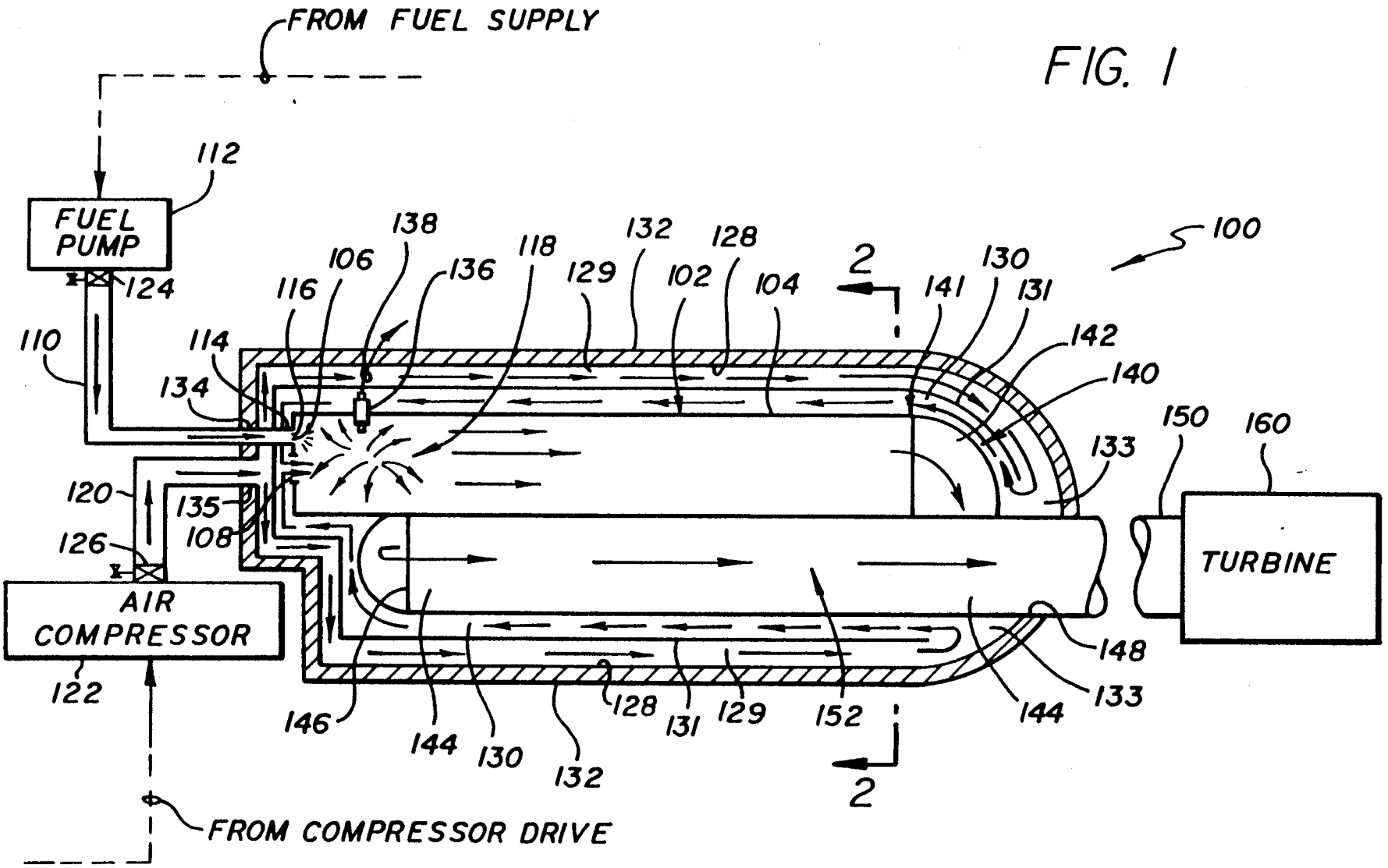
FIG. 1 is a simplified elevational view, partly in section, of an illustrative embodiment of the liquid fuel power plant of the present invention showing a combustion chamber including an extension having a folded tubular construction.

The invention is a liquid fuel power plant 100 as shown in FIG. 1. The power plant 100 includes an open-ended combustion chamber 102 which has no moving parts. The combustion chamber 102 preferably employed in the present invention is cylindrical and bounded by an outer wall 104 as shown in FIG. 1. A first cylindrical input port 106 and a second cylindrical input port 108 are formed in the outer wall 104. The first cylindrical input port 106 accommodates a fuel feed line 110 carrying a combustible hydrocarbon based fuel . The fuel is fed from a fuel source ( not shown ) through the fuel feed 1 ine 110 by conventional methods such as, for example, by a fuel pump 112 shown in FIG. 1. The fuel feed line 110 terminates in a fine spray nozzle 114 formed by punching a hole 116 in the end of the fuel feed line 110 for atomizing the fuel delivered to an ignition region 118. The small fuel droplets caused by atomizing the combustible fuel in the spray nozzle 114 results in higher efficiency ignition of cheaper fuels that are otherwise difficult to burn.

The second cylindrical input port 108 serves as an inlet port to the combustion chamber 102 for preheated compressed air or liquid oxygen. Within the ignition region 118 of the combustion chamber 102 , the compressed air or liquid oxygen is mixed in the correct proportions with the particular combustible fuel utilized. The compressed air or liquid oxygen serves as an oxidizer to sustain the burning of the combustible fuel in the ignition region 118. In the preferred embodiment of the liquid fuel power plant 100 shown in FIG. 1, compressed air is provided to an air inlet line 120 by an air compressor 122 . The air compressor 122 is one of a variety known in the art and is operated by a drive mechanism such as a rotating drive shift (not shown). Both the fuel feed line 110 and the compressed air inlet line 120 can include a gate control valve 124 and 126, respectively, to prevent the air-fuel mixture from backfeeding into the fuel pump 112 and the air compressor 122 via the lines 110 and 120, respectively.

Completely surrounding the cylindrical combustion chamber 102 is an outer cylindrical wall 128 best shown in FIG. 2. Located between the outer cylindrical wall 128 and the outer wall 104 of the combustion chamber 102 are first and second air passageways 129 and 130, respectively. Separating the first and second air passageways 129 and 130 is a cylindrical partition 131 as shown in FIGS. 1 and 2. The cylindrical partition 131 completely surrounds the combustion chamber 102 except in the region identified by the numeral 133 where the two passageways 129 and 130 interface. Additionally, the cylindrical partition 131 can be secured to either the outer cylindrical wall 128 or the outer wall 104 by any suitable means such as, for example, a bracket (not shown).

The first and second air passageways 129 and 130 separated by the cylindrical partition 131 form the equivalent of a duplex preheater manifold. The inlet air from the compressor 122 is directed to the first air passageway 129 via the air inlet line 120. The compressed inlet air is driven along the first air passageway 129 to the region 133. In the region 133, the inlet air is forced to enter the second air passageway 130 as shown in FIG. 1. The inlet air is then driven along the second air passageway 130 toward the second cylindrical input port 108. The inlet air passing through the second air passageway 130 is preheated by the heat of combustion escaping through the outer wall 104 of the combustion chamber 102. Preheating the inlet air forced along the second air passageway 130 in this manner increases the efficiency of combustion within the chamber 102. The preheated compressed air is then forced through the second cylindrical input port 108 and into the ignition region 118 of the combustion chamber 102. Thereafter, the preheated compressed air is mixed with the combustible liquid fuel delivered to the ignition region 118 by the first cylindrical input port 106.

Surrounding the outer cylindrical wall 128 is an insulated heat shield 132 as shown in FIGS. 1 and 2. The heat shield 132 serves to prevent the loss of heat generated by the combustion within the chamber 102. By containing heat normally dissipated to the environment, the efficiency of combustion in the chamber 102 is improved. The heat shield 132 is comprised of any suitable material for preventing the flow of heat past the outer cylindrical wall 128 of the combustion chamber 102. An example of a suitable material for the heat shield 132 is porous ceramic of the type having a bubble construction that insulates heat. Note that a pair of openings 134 and 135 are formed in the heat shield 132 and the outer cylindrical wall 128. The openings 134 and 135 are positioned to accommodate the fuel feed line 110 and the air inlet line 120, respectively, and are sealed about the respective lines as shown in FIG. 1 in a manner known.

Mounted within the outer wall 104 of the cylindrical combustion chamber 102 is an igniter 136. The igniter 136 extends into the combustion chamber 102 and functions to ignite the combustible air-fuel mixture within the ignition region 118. The igniter 136 can be one of several devices depending upon the hydrocarbon based fuel utilized in the power plant 100. For example, if a lightweight fuel such as natural gas, butane, propane or gasoline is employed, the igniter 136 can be a spark plug. For lightweight fuels, the spark plug is continuously energized. If a heavier fuel such as diesel is utilized, a spark plug continues to be the preferred igniter device. However, a glow plug can also be employed as the igniter 136. A glow plug incorporates a platinum wire that is constantly energized and glows white hot to ensure combustion of the air-fuel mixture. The igniter 136 is connected to an electrical circuit identified by the electrical lead 138 in FIG. 1 to provide a spark for burning the air-fuel mixture. A by-product of the combustion within the ignition region 118 of chamber 102 is hot pressurized gases which include pollutants. The presence of the gate control valves 124 and 126 prevent the hot pressurized gases from entering the fuel pump 112 and the air compressor 122, respectively.

The cylindrical combustion chamber 102 further includes an extension 140. In the present invention as shown in FIGS. 1-2, the combustion chamber extension 140 is connected to a terminal end 141 of the combustion chamber 102. The combustion chamber extension 140 comprises a tubular construction which is folded upon itself in two dimensions. The tubular extension 140 is hollow and continuous and the folded portions are in juxtaposition to one another. The tubular extension 140 includes an idler tube 142 and an output tube 144 best shown in FIG. 2. The idler tube 142 begins at the terminal end 141 of the combustion chamber 102 and is folded down and underneath the combustion chamber 102 at an angle as shown in FIG. 1. The idler tube 142 extends back toward the first and second cylindrical input ports 106 and 108, respectively. Then the idler tube 142 is folded in the horizontal plane so that the tubular construction of the extension 140 appears to be exiting the plane of the drawing shown in FIG. 1. The idler tube 142 ends and the output tube 144 begins at an interface point 146 shown in FIG. 1. The output tube 144 extends in the same direction as the combustion chamber 102 (e.g., away from the first and second cylindrical input ports 106 and 108, respectively). The idler tube 142 is folded at an angle with respect to the combustion chamber 102 to provide sufficient space to incorporate the fold from the idler tube 142 to the output tube 144. This design provides for space economy. The length of the extension 140 is dependent upon the operating temperature range and the grade of hydrocarbon based fuel utilized.

Figure 3:
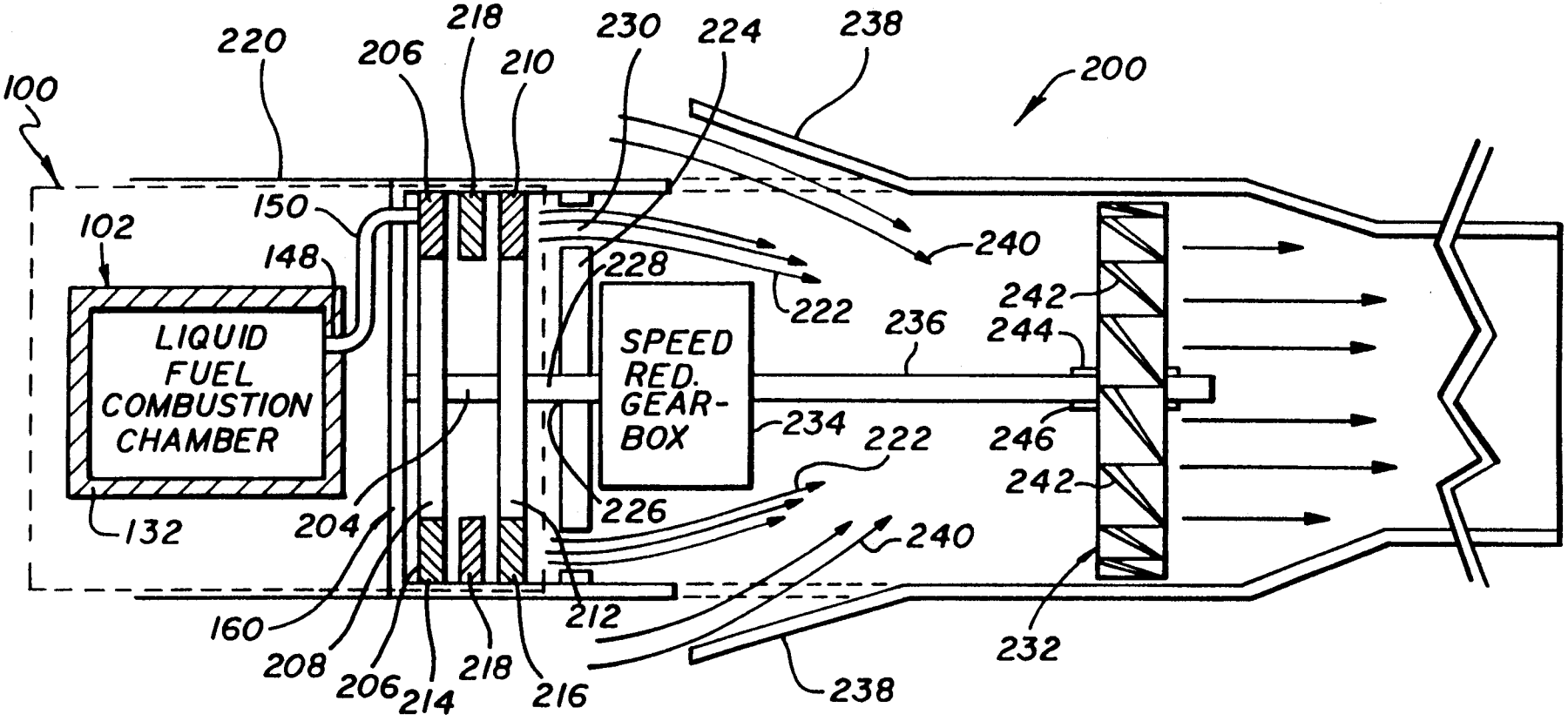
FIG. 3 is a simplified view, partly in section and partly in block, of an application of the liquid fuel power plant of the present invention showing the combustion chamber of FIG. 1 connected to a turbine within a typical projectile tube.

The idler tube 142 serves as an input end and the output tube 144 serves as an exhaust end of the extension 140 to facilitate receiving and exhausting the hot pressurized gases generated by the combustion of the air-fuel mixture. The idler tube 142 receives the hot pressurized gases forcibly repositioned from the ignition region 118 by the pressurized inlet air. The output tube 144 of the extension 140 passes through the outer cylindrical wall 128 and the insulated heat shield 132 at a penetration 148. Beyond the insulated heat shield 132, the output tube 144 of the combustion chamber extension 140 becomes an exhaust tube 150. The exhaust tube 150 is routed to a load via a turbine 160 as shown in FIGS. 1 and 3.

The hot pressurized gases are forced to travel from the ignition region 118 into the combustion chamber 102 by the expansion of the compressed air in the air-fuel mixture. A portion of the hot pressurized gases pass the folded section just beyond the terminal end 141 of the combustion chamber 102 and enter the extension 140. The folded section located at the entrance of the extension 140 reflects a portion of the hot pressurized gases. That portion of the hot pressurized gases not passing into the extension 140 is temporarily delayed from exiting the ignition region 118 of the combustion chamber 102. In particular, the delayed gases are forced to recirculate back to the ignition region 118. Further exposure of the hot pressurized gases to the ignition region 118 ensures complete combustion of the air-fuel mixture. The distance between the spray nozzle 114 at the end of the fuel feed line 110 and the idler tube 142 of the extension 140 should be a direct path as is shown in FIG. 1 to ensure proper recirculation and complete combustion of the gases.

The idler tube 142 and the output tube 144 are fabricated to provide a continuous pathway through the extension 140. The continuous pathway through the extension 140 serves to ensure that the combustion chamber 102 is open-ended for the passage of the hot pressurized gases therethrough. That portion of the hot pressurized gases that enter the folded tubular extension 140 saturate the walls of both the idler tube 142 and the output tube 144. Thus, the temperature of the combustion chamber extension 140 is raised to approximately that of the combustion chamber 102. The folded tubular extension 140 effectively lengthens and maintains the diameter of the combustion chamber 102. The length of the folded tubular extension 140 is dependent upon the dimensions of the combustion chamber 102 and on the type of fuel utilized. By lengthening the chamber 102 and by reusing the heat generated by the combustion, total burning of the air-fuel mixture and any hydrocarbon pollutants created in the chamber 102 is ensured. Lengthening the combustion chamber 102 via the extension 140 also prevents ignition termination (e.g., flame out) since the combustion can take place anywhere along the length of the extension 140.

The folded tubular extension 140 forms a "reaction region" 152 which ultimately is connected to the exhaust tube 150 at the output tube 144 in a manner known in the art as shown in FIG. 1. The reaction region 152 extends from the idler tube 142 at the entrance of the folded tubular extension 140 to the output tube 144. The hydrocarbon pollutants created in the ignition region 118 are either burned and disintegrated or are forced to decompose to the base elements in the reaction region 152 due to the presence of the heat and oxygen. Thus, the folded tubular extension 140 functioning as a reaction region 152 expels very low pollution gases to the exhaust tube 150 as shown in FIG. 1. The very low pollution gases are thereafter directed to a mechanism such as the turbine 160 for driving a load as described hereinbelow. Further, the reaction region 152 of the extension 140 enables the use of a very lean air-fuel mixture which improves the efficiency of operation.

The combustion chamber 102 and the associated folded tubular extension 140 are each formed of high temperature ceramic or metal and can withstand temperatures in excess of 3000 degrees Fahrenheit. The extension 140 can be attached to the combustion chamber 102 by any suitable method known in the art. However, unitary construction represents a preferred method of connecting the extension 140 to the combustion chamber 102. In either case, the combustion chamber 102, the extension 140 and any connecting structure should be comprised completely of ceramic or metal. An example of a suitable metal for use in forming the combustion chamber 102 and the extension 140 including the outer wall 104 is a nickel-steel based alloy. Likewise, the exhaust tube 150 and structure associated therewith are formed from either ceramic or metal that is consistent with the material comprising the combustion chamber 102. In general, the nickel alloy construction is employed for lower temperature operations while the ceramic construction is utilized for higher temperature operations.

The hot pressurized gases exiting the combustion chamber extension 140 cause the temperature of the output tube 144 of the extension 140 and the exhaust tube 150 to be very high. The compressed air passing through the second air passageway 130 contacts the outer wall 104, the idler tube 142 and the output tube 144 resulting in heat transfer to the incoming compressed air. Thus, the combustion chamber 102 and the folded tubular extension 140 also serve to preheat the incoming compressed air to increase the efficiency of the power plant 100. Thereafter, the output tube 144 of the extension 140 passes through the outer cylindrical wall 128 and the heat shield 132 via the penetration 148. The penetration 148 is then sealed in a manner known in the art. Additionally, the air inlet line 120 and the outer cylindrical wall 128 are each comprised of a material consistent with the material used in the combustion chamber 102. A nickel-steel based alloy can be used for applications to 2000 degrees Fahrenheit while ceramic can be utilized for applications at higher temperatures.

A cross-sectional view of the folded tubular extension 140 and the combustion chamber 102 is shown in FIG. 2. A section of the cylindrical combustion chamber 102, the idler tube 142 and the output tube 144 is shown to illustrate the tubular, hollow interior of each. Further, the relationship between the outer wall 104 of the combustion chamber 102, the idler tube 142, the output tube 144, the cylindrical partition 131, the outer cylindrical wall 128 and the insulated heat shield 132 is also shown. Although part of FIG. 1 is shown in cross-section, the view of FIG. 2 shows the power plant 100 in full cross-section to permit an appreciation of the relationship between the associated structure. The combustion chamber 102 is shown angularly displaced from and connected to the idler tube 142 of the extension 140 by phantom lines. Likewise, the idler tube 142 is shown connected to the output tube 144 in the horizontal plane by additional phantom lines. Further, the first and second air passageways 129 and 130 are shown separated by the cylindrical partition 131 inside the outer cylindrical wall 128.

During operation, the liquid fuel power plant 100 functions in the following manner. The combustible fuel is forced through the fuel feed line 110 by the fuel pump 112 and directed to the fine spray nozzle 114. Simultaneously, the air compressor 122 delivers compressed air to the first air passageway 129 which is subsequently preheated in the second air passageway 130. The preheated compressed air is then forced into the combustion chamber 102 via the second cylindrical input port 108. The compressed air and atomized combustible fuel are mixed in the combustion chamber 102 as shown in FIG. 1. The air-fuel mixture is ignited by the igniter 136 resulting in combustion in the ignition region 118 of the combustion chamber 102. The small fuel droplets provided by atomizing the combustible fuel in the spray nozzle 114 results in higher efficiency ignition. The air-fuel mixture burns and generates hot expanding gases. The pressure of the hot expanding gases is derived from the pressure of the compressed air and the expansion of the air when the fuel is combusted.

As the present combustion of the air-fuel mixture takes place in the combustion chamber 102, the gases from the immediate previous combustion will be forced toward the reaction region 152 of the folded tubular extension 140 by the pressure of the expanding gases. A portion of the hot pressurized gases from the ignition region 118 passes into the idler tube 142 of the extension 140. The portion of the hot pressurized gases not passing into the idler tube 142 of the extension 140 due to the folded construction is temporarily delayed from exiting the ignition region 118. The delayed gases are exposed to the ignition region 118 a second time to ensure complete combustion of the air-fuel mixture. The portion of the hot expanding gases passing into the idler tube 142 travel into the folded tubular extension 140. The idler tube 142 and the output tube 144 of the combustion chamber extension 140 retain sufficient heat from the hot pressurized gases to ensure complete combustion or decomposition of the fuel and any residual pollutants before reaching the exhaust tube 150. The exhaust gases are, therefore, very nearly pollution free and can be controlled to produce useful work such as providing shaft power output from the power plant 100.

The combustion chamber 102 of the liquid fuel power plant 100 is operated within the temperature range of from 400 degrees Fahrenheit to 2000 degrees Fahrenheit. The exhaust gases are therefore within the low-to-medium temperature range while the pressure of the exhaust gases is within the low-to-medium pressure range (e.g., up to 100 PSI). This temperature range has been selected to ensure complete combustion of the fuel while avoiding production of nitrous oxides ($NO_x$). Operating temperatures above 2000 degrees Fahrenheit result in the production of higher nitrous oxide ($NO_x$) levels. By operating the combustion chamber 102 in the selected temperature range, the fuel will be completely combusted or decomposed to basic pollution free elements such as carbon, hydrogen and oxygen. Therefore, the combustion chamber 102 functions as a catalytic converter in the selected temperature range.

Any inexpensive fuel can be used in the combustion chamber 102 including diesel, kerosene, JP fuels and natural gas. By atomizing the combustible fuel in the spray nozzle 114, cheaper fuels that are otherwise difficult to burn can be utilized. By varying the proportions of compressed air and fuel, the proper mixture can be determined to ensure total combustion of the fuel. Total combustion means that all the energy in the fuel has been utilized. Each individual fuel will require an adjustment of the proportion of the compressed air utilized. After the correct mixture of air and fuel is achieved, less fuel will be necessary to generate the energy to accomplish a task than was previously required for other known power plants using the same fuel.

The liquid fuel power plant 100 of the present invention is a small, lightweight, multi-fuel non-polluting combustion engine in which the low-to-medium temperature and pressure exhaust gases are employed to operate a load. The combustion chamber 102 has no moving parts and is a stand-alone device that utilizes inexpensive hydrocarbon based fuels. The power plant 100 is very versatile in that it can be used for developing hot pressurized gases for use in, for example, an electrical generator, a turbine water pump, a recreational vehicle, a garden tractor, a battery charger, a small aircraft or a projectile. More specifically, when utilized with a turbine wheel to rotate a drive shaft, the power plant 100 provides inexpensive pollution free power to propel unmanned air vehicles or to operate an electrical generator to provide AC or DC voltage and current.

One of the many applications of the liquid fuel power plant 100 is shown in FIG. 3. The power plant 100 is shown located within a projectile 200 and is utilized to rotate the turbine 160 at high RPM. The exhaust tube 150 is connected between the end of the combustion chamber extension 140 and the turbine 160 as shown in FIG. 1. The pressurized gases generated by the combustion chamber 102 are directed through the exhaust tube 150 to spin the turbine 160 about a turbine axis 204 as shown in FIG. 3 and described hereinbelow. Note that it is also possible to connect the exhaust tube 150 of the combustion chamber 102 to a manifold (not shown) and then to connect a plurality of exhaust tubes from the manifold to the turbine 160. In either case, the pressurized gases are directed to the turbine 160 which is of a conventional design comprising one or more turbine blade wheels.

The turbine 160 of the power plant 100 shown in FIG. 3 depicts a two stage turbine for illustration purposes only. It is to be understood that a single stage turbine or a multiple stage turbine (e.g., greater than one stage) can also be utilized. In general, multiple stage turbines impart greater efficiency and horsepower. It is further noted that the pressure range of the hot gases produced by the power plant 100 is also dependent upon the number of turbine stages and the number and shape of the blades per turbine stage. The turbine 160 includes a first turbine stage 206 having a first rotating wheel 208 and a second turbine stage 210 having a second rotating wheel 212. The end of the first rotating wheel 208 includes a first set of turbine blades 214 and the end of the second rotating wheel 212 includes a second set of turbine blades 216. Positioned between the first and second sets of turbine blades 214 and 216 is a stationary set of blades 218 commonly referred to as stators. Stators are utilized to condition or redirect the gases for the next turbine stage.

The pressurized gases generated by the combustion chamber 102 are directed to the first turbine stage 206 by the exhaust tube 150. Since the first and second sets of turbine blades 214 and 216 are respectively connected to the first and second rotating wheels 208 and 212, then each set of turbine blades 214 and 216 also rotate. The pressurized gases initially strike the first set of turbine blades 214 which causes the first rotating wheel 208 of the first turbine stage 206 to rotate about the axis 204. The gases are then redirected to the stationary set of blades 218. The stationary set of blades 218 is mounted to an outer tube or metal housing 220 of the projectile 200 as shown in FIG. 3. In the example implementation, the shape of the stationary set of turbine blades 218 is opposed to that of the first and second sets of turbine blades 214 and 216. Thus, a function of the stationary set of blades 218 is to redirect and condition the gases from the output of the first rotating wheel 208 to the second turbine stage 210. The stationary set of blades 218 also orients the gases to the correct angle to achieve the maximum energy transfer to the second turbine stage 210.

The gases are then directed from the stationary set of blades 218 to the second set of turbine blades 216. When the gases strike the second set of turbine blades 216, the second rotating wheel 212 is caused to rotate about the turbine axis 204. In general, the first turbine stage 206 is approximately 75% efficient while the second turbine stage 210 is approximately 10% efficient. A third turbine stage, if employed, would be approximately 5% efficient with the remainder of the energy in the pressurized gases being lost as heat energy. The density, temperature and pressure of the gases emitted from the exhaust tube 150 will determine the rotational speed in RPM of the turbine 160. As an example, a turbine wheel having a diameter of 5" and a drive shaft length of 4" and weighing approximately five pounds can be rated to provide a forty horsepower output.

The exhaust gases (indicated by numeral 222) expelled from the second turbine stage 210 will be at or near atmospheric pressure. This indicates that the first and second turbine stages 206 and 210 have absorbed almost all of the energy contained in the gases. Therefore, noise is not likely to be generated by the gases. This feature further minimizes the generation of noise in the entire power plant 100 making it more difficult to detect with audible detection devices. Thus, the power plant 100 is more attractive for use in stealth type devices.

The exhaust gases 222 are then directed from an exhaust region of the turbine 160 to a diffuser plate 224 as shown in FIG. 3. In the example implementation of the present invention, the diffuser plate 224 is a metallic plate mounted to the inside surface of the outer tube 220 of the projectile 200. The diffuser plate 224 includes a penetration 226 for the passage of a drive shaft 228. One of the functions of the diffuser plate 224 is to direct the exhaust gases out of the exhaust region of the turbine 160 through a passageway 230 to a load such as a ducted fan type propeller 232 positioned within the projectile 200. Another function of the diffuser plate 224 is to absorb additional energy from the gases. This action causes the gases to slow down further minimizing the noise generated by the power plant 100.

The rotating drive shaft 228 can be connected to a speed reduction gearbox 234 to achieve the proper rotational speed for the load attached to the power plant 100. The load is attached to the power plant 100 via an output drive shaft 236 extending from the speed reduction gearbox 234 as shown in FIG. 3. It is noted that the speed reduction gearbox 234 can be of a conventional design and is an optional feature that may not be necessary in a particular load application. A plurality of loads can be driven by the power plant 100. When the power plant 100 is utilized to propel the projectile 200, an appropriate load is the ducted fan type propeller 232 shown in FIG. 3.

The metal housing or outer tube 220 of the projectile 200 includes a vent flap 238 as shown in FIG. 3. The function of the vent flap 238 is to admit ambient air (indicated by the numeral 240) into the projectile 200. The ambient air 240 is drawn into the projectile 200 by the ducted fan type propeller 232. The ambient air 240 is then mixed with the exhaust gases 222 from the turbine 160 to dissipate the heat contained therein. The dissipation of the heat in the exhaust gases 222 makes the power plant 100 and the projectile 200 less vulnerable to detection by infrared type sensor devices. The ambient air and exhaust gas mixture is then fed to the ducted fan type propeller 232 to provide the thrust to propel the projectile 200.

The ducted fan type propeller 232 is internally located within the metal housing or outer tube 220 as shown in FIG. 3. The ducted fan type propeller 232 serves to provide the thrust to the projectile 200 by compressing (e.g., speeding up) the air as the air passes through the outer tube 220. Since the ducted fan type propeller 232 is located inside of the outer tube 220, it is usually of a small size. A plurality of fan blades 242 of the ducted fan type propeller 232 is shown in FIG. 3. The fan blades 242 are shown mounted to a center cog 244 having a center penetration 246 for accommodating the output drive shaft 236. The fan blades 242 serve to compress the air mixture. The number of fan blades 242 and the RPM at which they rotate provide a certain level of thrust to the projectile 200. The RPM of the fan blades 242 is directly related to the output of the turbine 160 and the speed reduction gearbox 234, if used.

Other examples of the utility of the present invention exist which include the instant liquid fuel power plant 100 as shown in FIG. 1 and in block form in FIG. 3. In the other examples, the power plant 100 interfaces with the turbine 160 and the drive shaft 228 as described above. However, the ducted fan type propeller 232 is replaced by another load. For example, the load can be a DC or an AC electrical generating device (not shown) used to provide power to other electrical loads. Thus, a variety of loads can be substituted for the ducted fan type propeller 232.

Figure 4:
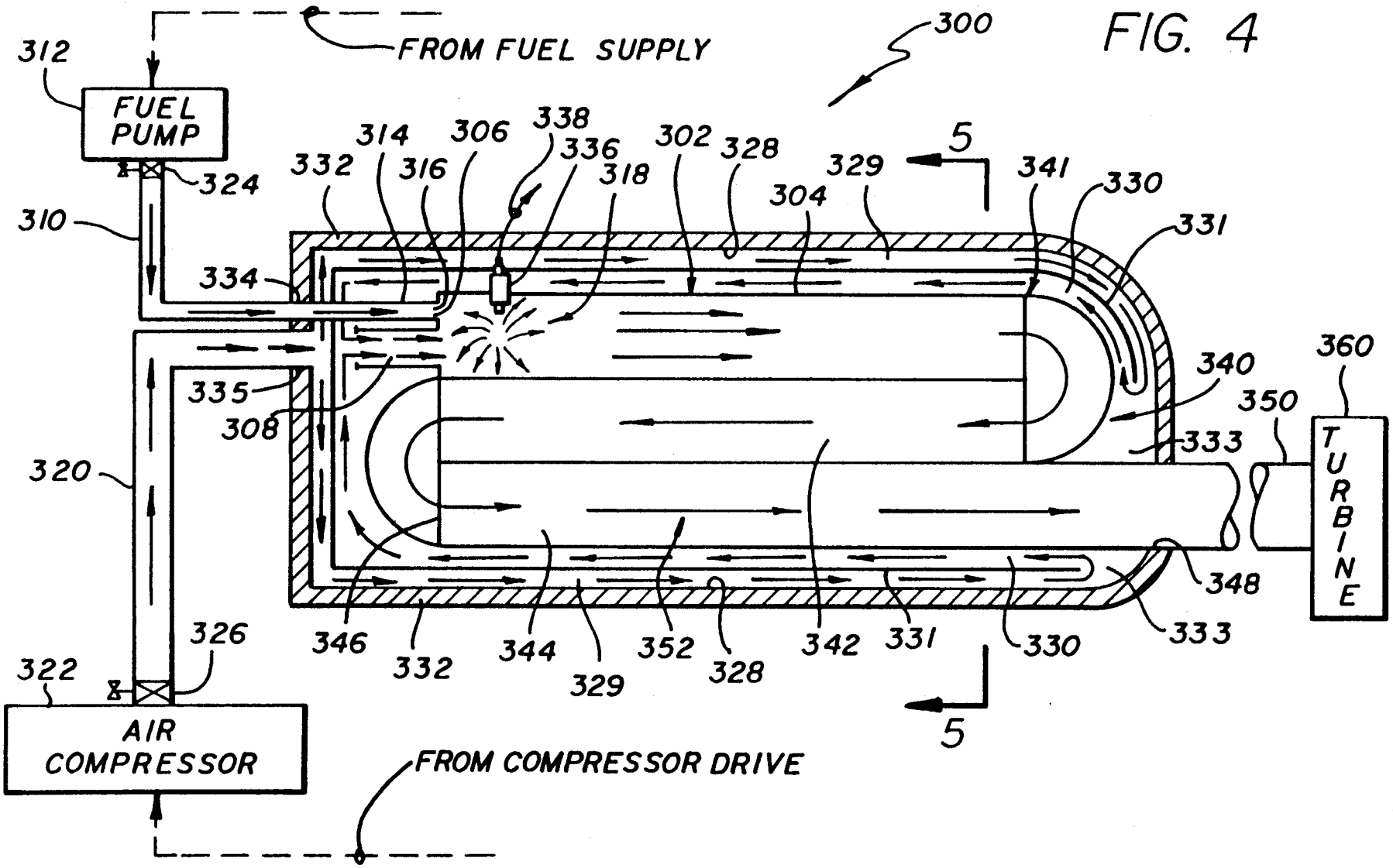
FIG. 4 is a simplified elevational view, partly in section, of an alternative embodiment of the liquid fuel power plant of the present invention showing a combustion chamber including an extension having another folded tubular construction.

An alternative embodiment of the present invention is disclosed in FIGS. 4 and 5. In this instance, the alternative embodiment of the liquid fuel power plant shown in FIGS. 4 and 5 includes a combustion chamber extension of the type similar to that shown in FIGS. 1–3. Those components of the liquid fuel power plant of FIGS. 4 and 5 which find substantial correspondence in structure and function to those parts of FIGS. 1–3 are designated with corresponding numerals of the three-hundred series.

The liquid fuel power plant 300 includes a combustion chamber 302 which is bounded by an outer wall 304 as shown in FIGS. 4 and 5. First and second cylindrical input ports 306 and 308 are formed in the outer wall 304. A fuel feed line 310 is shown carrying a combustible hydrocarbon based fuel into the combustion chamber 302 through the first cylindrical input port 306. The fuel is fed from a fuel source (not shown) through the fuel feed line 310 by conventional methods such as, for example, by a fuel pump 312 shown in FIG. 4. The fuel inlet line 310 terminates in a fine spray nozzle 314. The fine spray nozzle 314 is formed by punching a hole 316 in the end of the fuel inlet line 310. The hole 316 formed in the end of the spray nozzle 314 facilitates the atomizing of the fuel delivered to an ignition region 318. The small fuel droplets caused by atomizing the combustible fuel in the spray nozzle 314 result in higher efficiency ignition of cheaper fuels that are other-wise difficult to burn.

The second cylindrical input port 308 serves as an inlet port to the combustion chamber 302 for preheated compressed air or liquid oxygen as described with respect to power plant 100. In the ignition region 318, the compressed air or liquid oxygen is mixed in the correct proportions with the liquid fuel to serve as an oxidizer to sustain the burning of the fuel. The compressed air is provided to the combustion chamber 302 through an air inlet line 320 by an air compressor 322. Completely surrounding the cylindrical combustion chamber 302 is an outer cylindrical wall 328 and an insulated heat shield 332 which are best shown in FIG. 5. The air compressor 322, the outer cylindrical wall 328 and the heat shield 332 are each duplicate in structure and function to that described in power plant 100.

Located between the outer cylindrical wall 328 and the outer wall 304 are first and second air passageways 329 and 330, respectively. Separating the first and second air passageways 329 and 330 is a cylindrical partition 331 as shown in FIGS. 4 and 5. The cylindrical partition 331 completely surrounds the combustion chamber 302 except in the region identified by the numeral 333 where the two passageways 329 and 330 interface. The first and second air passageways 329 and 330 separated by the cylindrical partition 331 form the equivalent of a duplex preheater manifold. The inlet air from the compressor 322 is directed to the first air passageway 329 and then is forced to enter the second air passageway 330 in region 333. The inlet air is preheated by the heat of combustion escaping through the outer wall 304 and is then directed to the second cylindrical input port 308. The construction and operation of the air passageways 329 and 330 is duplicate to that described in the power plant 100.

Mounted within the outer wall 304 of the combustion chamber 302 is an igniter 336 as shown in FIG. 4. The igniter 336 extends into the combustion chamber 302 and functions to ignite a combustible air-fuel mixture within the ignition region 318. The igniter 336 can be one of several devices depending upon the hydrocarbon based fuel utilized in the power plant 300. The selection of the igniter 336 is based upon the same criteria as those presented with respect to the power plant 100. For lightweight fuels, the igniter 336 can be a spark plug which is continuously energized. If a heavier fuel is utilized, a spark plug continues to be the preferred igniter device but a glow plug can also be employed. The igniter 336 is connected to an electrical circuit identified by the electrical lead 338 to provide a spark for burning the air-fuel mixture. A by-product of the combustion within the ignition region 318 of chamber 302 is hot pressurized gases which include pollutants.

The cylindrical combustion chamber 302 further includes an extension 340 as shown in FIGS. 4 and 5. The combustion chamber extension 340 is connected to a terminal end 341 of the combustion chamber 302. The combustion chamber extension 340 comprises a tubular construction which is folded upon itself in a single dimension. The tubular extension 340 is hollow and continuous and the folded portions are in juxtaposition to one another. The tubular extension 340 includes an idler tube 342 and an output tube 344 best shown in FIG. 5. The idler tube 342 begins at the terminal end 341 of the combustion chamber 302 and is folded down and underneath the combustion chamber 302 as is clearly shown in FIG. 4. The idler tube 342 extends back toward the first and second cylindrical input ports 306 and 308.

The idler tube 342 is then folded down and underneath to form the output tube 344. The idler tube 342 ends and the output tube 344 begins at an interface point 346 shown in FIG. 4. Note that the first fold which forms the idler tube 342 and the second fold which forms the output tube 344 are located on opposite ends of the power plant 300. The output tube 344 then extends away from the first and second cylindrical input ports 306 and 308. Note that the combustion chamber 302, the idler tube 342 and the output tube 344 are all stacked in a vertical line as is shown in FIG. 5. The vertical construction is a distinguishing feature between the power plant 300 and the power plant 100. The vertical construction of the power plant 300 provides a more space economic design. The output tube 344 then passes through a penetration 348 in the heat shield 332 to form an exhaust tube 350. The length of the folded tubular extension 340 is dependent upon the operating temperature range and the grade of hydrocarbon based fuel utilized. The operation of the folded tubular extension 340 of the power plant 300 is duplicate to that previously described for the folded tubular extension 140 of the power plant 100.

Each of the remaining elements of the liquid fuel power plant 300 shown in FIGS. 4 and 5 and the operation thereof is duplicate to that previously disclosed in the power plant 100.

Thus, the present invention has been described herein with reference to a particular embodiment for a particular application. Those having ordinary skill in the art and access to the present teachings will recognize additional modifications, applications and embodiments within the scope thereof. Although the detailed description is directed to a turbine driven air vehicle application, the liquid fuel power plant 100 of the present invention is equally applicable to driving a generator or similar device.

It is therefore intended by the appended claims to cover any and all such modifications, applications and embodiments within the scope of the present invention.

Accordingly,

What is claimed is:

1. A liquid fuel power plant comprising:

a tubular combustion chamber having an ignition region for receiving combustible liquid fuel and an oxidizer, and having means for igniting said fuel in said ignition region, the combustible fuel being ignited in said ignition region to produce hot pressurized gases in said combustion chamber;

means for delivering said combustible liquid fuel to said ignition region;

means for delivering said oxidizer to said ignition region;

a tubular extension chamber having a first end and a second end, said tubular-shaped chamber being coupled at the first end to the tubular combustion chamber to receive said hot pressurized gases from said combustion chamber, said tubular-shaped chamber providing a reaction region for further combustion of said hot pressurized gases received from said combustion chamber, said further combusted hot pressurized gases being exhausted at the second end of said tubular extension chamber, said tubular extension chamber being folded to be disposed parallel to and side-by-side to said tubular combustion chamber means for using said further combusted hot pressurized gases being exhausted at the end of said tubular extension chamber to perform useful work.

2. A liquid fuel power plant as recited in claim 1, wherein said tubular extension chamber includes:

an idler portion coupled to redirect hot pressurized gases received from the tubular combustion chamber in a direction opposite to and parallel to the direction of the hot pressurized gases received by said idler portion.

3. A liquid fuel power plant as recited in claim 2, wherein said tubular extension chamber includes:

an output portion coupled to redirect hot pressurized gases received from the idler portion combustion chamber in a direction opposite to and parallel to the direction of the hot pressurized gases received by said output portion.

4. A liquid fuel power plant as recited in claim 3 wherein said tubular combustion chamber, said idler portion of said tubular extension chamber, and said output portion of said tubular extension chamber are disposed in a triangular relationship.

5. A liquid fuel power plant as recited in claim 3 wherein said tubular combustion chamber, said idler portion of said tubular extension chamber, and said output portion of said tubular extension chamber are disposed in a stacked relationship.

6. A liquid fuel power plant as recited in claim 1 further comprising heat shield means disposed for retaining heat in said tubular combustion chamber and said tubular extension chamber.

7. A liquid fuel power plant as recited in claim 6 wherein said means for delivering said oxidizer to said ignition region includes said heat shield means being disposed away from said tubular combustion chamber and said tubular extension chamber to provide a passageway for heating pressurized air from an air inlet line; and further including a portion to separate said passage way into first and second parallel air passageways through which said pressurized air is consecutively directed.

8. A liquid fuel power plant as recited in claim 3 further comprising heat shield means disposed for retaining heat in said tubular combustion chamber and said tubular extension chamber.

9. A liquid fuel power plant as recited in claim 8 wherein said means for delivering said oxidizer to said ignition region includes said heat shield means being disposed away from said tubular combustion chamber and said tubular extension chamber to provide a passageway for heating pressurized air from an air inlet line; and further including a partition to separate said passage way into first and second parallel air passageways through which said pressurized air is consecutively directed.

* * * * *